United States Patent [19]

Kosek et al.

[11] 4,296,888

[45] Oct. 27, 1981

[54] POWDERED COAL AIR DISPERSION NOZZLE

[75] Inventors: Thomas P. Kosek, East Detroit; Eric A. Steinhilper, Mt. Clemens, both of Mich.

[73] Assignee: General Motors Corporation, Detroit, Mich.

[21] Appl. No.: 125,469

[22] Filed: Feb. 28, 1980

[51] Int. Cl.[3] ..... B05B 7/10

[52] U.S. Cl. ..... 239/403; 431/182

[58] Field of Search ..... 239/403, 399, 524, 518, 239/265.15, 127, 467; 431/182; 60/39.65

[56] References Cited

U.S. PATENT DOCUMENTS

| | | | |
|---|---|---|---|
| 1,909,660 | 5/1933 | Coberly | 239/403 X |
| 2,601,000 | 6/1952 | Nerad | 60/39.65 |
| 3,076,607 | 2/1963 | Cordier | 239/403 X |
| 3,271,304 | 9/1966 | Valdespino et al. | 239/403 X |
| 3,589,314 | 6/1971 | Tratz | 239/399 X |
| 3,591,086 | 7/1971 | Levin | 239/265.15 |
| 3,659,786 | 5/1972 | Winkeler | 239/5 |
| 3,691,765 | 9/1972 | Carlisle | 239/524 X |
| 3,840,181 | 10/1974 | Vier et al. | 239/127 |
| 4,157,889 | 6/1979 | Bonnel | 431/182 |

*Primary Examiner*—Robert B. Reeves
*Assistant Examiner*—Gene A. Church
*Attorney, Agent, or Firm*—J. C. Evans

[57] ABSTRACT

An improved coal/air dispersion nozzle introduces fuel into the combustion chamber of a gas turbine engine as a finely atomized, dispersed spray for a uniform combustion. The nozzle has an inlet that receives finely powdered coal from a coal transport or coal/air fluidizer system and a scroll swirl generator is included within the nozzle to swirl a fluidized coal/air mixture supplied to the inlet of the nozzle. The scroll is in the form of a thin, flat metal sheet insert, twisted along its length, and configured to prevent build-up of coal particles within the nozzle prior to ejection from its outlet. Airblast air jets are included along the length of the nozzle body to assist in the discharge of the fluidized coal from the nozzle outlet and an angular pintle tip overlies the outlet to redirect coal/air mixture through a desired fluidized coal spray angle.

4 Claims, 7 Drawing Figures

POWDERED COAL AIR DISPERSION NOZZLE

This invention relates to nozzle assemblies and more particularly to nozzle assemblies for dispersing a fluidized coal/air mixture into a combustion apparatus for a gas turbine engine.

Various proposals have been suggested to direct an atomized stream of coal particles into a combustion chamber. An example of such an arrangement is set forth in U.S. Pat. No. 3,589,314, issued June 29, 1971, to Tratz et al, for "Method and Device for Pressure Spraying and Burning a Coal Dust-Water Mixture."

Other nozzle arrangements for injecting coal particles into a combustion chamber are set forth in U.S. Pat. Nos. 3,659,786, issued May 2, 1972, to Vier et al for "Process and Installation for Burning Combustible Mixtures;" 3,840,181, issued Oct. 8, 1971, to Vier et al for "Installation for Burning Combustible Mixtures" and 3,591,086, issued July 6, 1971, to Levin, for "Nozzle for Injection of Slurry Fuels;" and 4,157,889, issued June 12, 1979, to Bonnel for "Burner for Powdered Fuel."

The present invention is directed to an improved powdered coal flow distributing nozzle having a twisted ribbon type scroll swirl generator for producing a swirl pattern in fluidized coal supplied to the nozzle and for preventing coal compaction within the nozzle assembly during its operation.

An object of the present invention is to improve introduction of a fluidized coal/air mixture as a cone of fuel sprayed into a combustor by the provision of a nozzle having a high length width ratio swirler therein to produce a swirl in a fluidized coal/air mixture which is sustained in flow from the nozzle.

Another object of the present invention is to provide a nozzle as set forth in preceding object including further provision of air jet means to boost the flow of the swirled fluidized coal/air mixture in the nozzle and to include means to vary the air pressure of the air jet means to vary angle of the cone of fuel sprayed from the nozzle thereby to control recirculation of combustion products in the combustor and consequently to control combustor emissions.

Still another object of the present invention is to provide an improved powdered coal/air dispersion nozzle for receiving a fluidized air/coal fuel mixture and directing it into combustion apparatus for a gas turbine engine through a predetermined spray cone angle and wherein the nozzle includes an elongated body having an inlet port at one end thereof and an outlet port at the opposite end thereof and wherein a scroll swirl generator in the form of a thin cross-sectioned sheet metal member twisted along its length imparts a continuous swirl to the fluidized air/coal mixture supplied to the inlet port of the nozzle body; the member having a length-to-width ratio greater than one to sustain the swirl in the fluidized air/coal mixture as it as discharged from the outlet port of the nozzle and wherein the scroll swirl generator includes an inlet end tapered to maintain separation of coal particles from the fluidized coal/air mixture and to prevent compaction thereof in the nozzle during its operation.

Yet another object of the present invention is to provide an improved powdered coal/air dispersion nozzle for receiving a fluidized air/coal mixture from a coal supply source and directing it into a combustor for a gas turbine engine wherein the nozzle includes an inlet port connected to a source of fluidized coal/air mixture and an outlet port in communication with the combustor and wherein an elongated sheet metal scroll member located within the nozzle tube has spaced longitudinal edges thereof in engagement with the tube to define a helically formed flow passage through the nozzle tube to impart a continuous swirl action on the fluidized coal/air mixture to prevent separation of coal particles from the mixture and wherein the scroll member has a length-to-width ratio greater than one to sustain swirl in the fluidized coal/air mixture as it passed from the outlet port and wherein additional air jets are located along the length of the nozzle to direct air jets into at least part of the helically formed flow path through the nozzle at an inclination with respect to the longitudinal axis of the nozzle tube to impart further axial thrust on the fluidized air/coal mixture to boost flow through the nozzle.

Further objects and advantages of the present invention will be apparent from the following description, reference being had to the accompanying drawings wherein a preferred embodiment of the invention is clearly shown.

Figure 1:
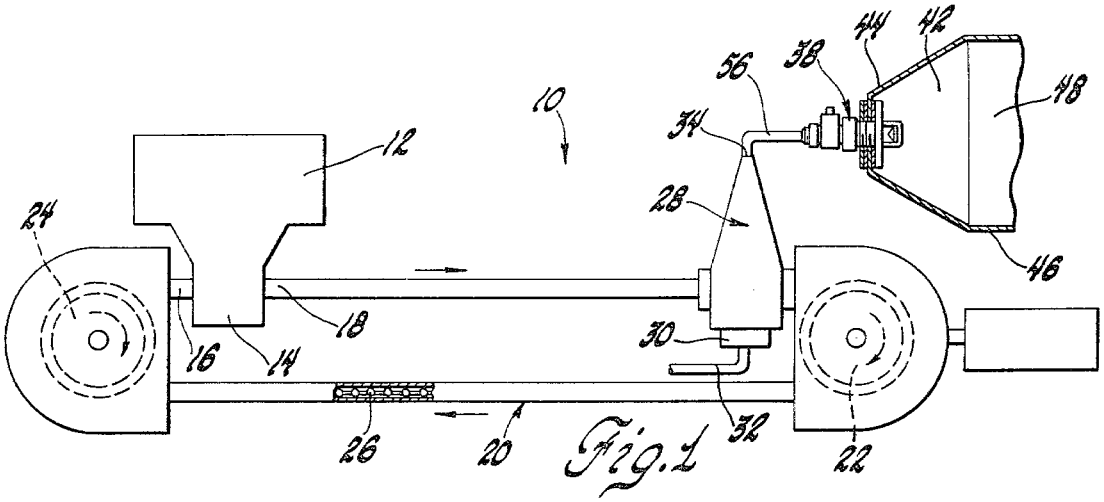
FIG. 1 is a diagrammatic view of a coal distribution system to a combustion chamber of a gas turbine engine including the powdered coal/air dispersion nozzle of the present invention.

Referring now to FIG. 1, a powdered coal distribution system 10 is illustrated including a powdered coal hopper 12 containing finely ground powdered coal in the range of from one to three hundred micron size. A distributor base 14 on the hopper 12 has an inlet 16 and an outlet 18 in communication with a continuous loop conveyor 20 with spaced apart sprockets 22, 24 for continuously driving a chain conveyor 26 through the distributor base 14 thence through an air/coal fluidizer 28 having an air/jet aerator 30 that directs pressurized air from an inlet tube 32 through the chain conveyor 26 so as to disperse powdered coal particles therefrom into a fluidized state for discharge through an outlet 34 of the coal/air fluidizer 28. Outlet 34 is in communication with the inlet port 36 of a powdered coal/air dispersion nozzle 38 that includes a discharge port 40 therefrom in communication with an interior space 42 defined by the domed end 44 of a combustor 46 for a gas turbine engine.

In accordance with the present invention, the powdered coal/air dispersion nozzle 38 is operative to introduce a spray cone of swirled coal and air into the space 42 which communicates with a primary combustion chamber 48 of a combustor 46 as a finely dispersed mixture of air and fuel which is readily combusted within the combustion chamber 48 during gas turbine engine operation.

Figure 2:
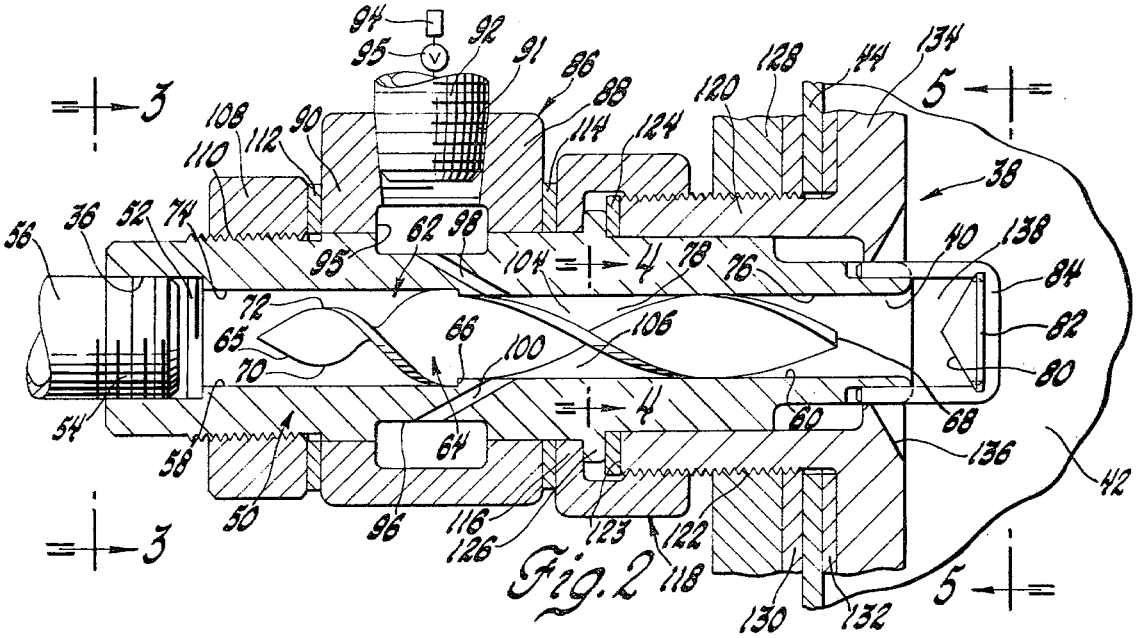
FIG. 2 is a longitudinal sectional view of the nozzle of the present invention with a scroll swirl generator therein shown in elevation.

As best shown in FIG. 2, the nozzle 38 includes an elongated body 50 with the inlet port 36 at one end thereof and the outlet port 40 at the opposite end thereof. The inlet port 36 has internal threads 52 therein that threadably receive one end 54 of a connection tube 56 between the outlet 34 of the coal/air fluidizer 28 and the nozzle body 50. The connection tube 56 constitutes a source of fluidized coal with coal particles therein sized in the range of one to three hundred microns. This fluidized mixture flows from the tube 56 into a bore 58 at one end of the housing 50. The bore 58 is of slightly greater diameter than a bore segment 60 axially aligned with and downstream of bore 58. Bore 60 leads to the outlet port 40. A scroll swirl generator 62 includes a thin cross section and elongated sheet metal element 64 twisted along its length is located in bores 58, 60. More particularly, the scroll swirl generator 62 includes a tapered inlet end 65 in bore 58. From inlet end 65 the sheet metal element 64 is twisted along its length in the bore 58 to a stepped shoulder 66 thereon which locates the element 64 axially within the bores 58, 60. Downstream of the stepped shoulder 66 the element 64 is further twisted along its length to an outlet edge 68 located immediately upstream of the outlet 40. The element 64 includes longitudinal edges 70, 72 thereon located in sealed engagement with the inner surfaces 74, 76 of the bores 58, 60, respectively, to define a helically formed coal/air passage 78 between the element 64 and the surfaces 74, 76. The element 64 presents a small projected area of thin cross-section axially throughout the bores 58, 60 to prevent compaction of coal particles along the length of passage 78. Furthermore, because of the helical coal/air passage 78 the coal/air mixture is continuously swirled to maintain its fluidized state. Moreover, the length-to-diameter ratio (L/D) of the scroll generator element 64 is greater than one. The illustrated arrangement has a 450° twist between the tapered inlet end 65 and the outlet edge 68 and an L/D ratio of 6.7. The resultant continuously twisting path through passage 78 imposes a swirl on the mixture of fluidized powdered coal particles within the air flow through the nozzle 38 so that the coal/air mixture swirl will be sustained as the mixture flows from the outlet 40.

Figure 5:
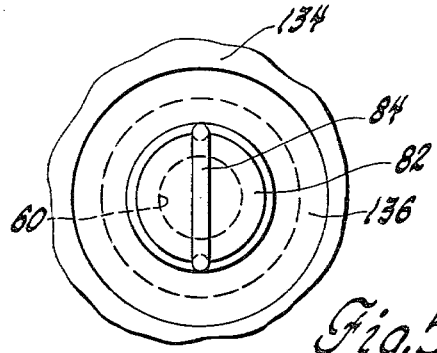
FIG. 5 is an end elevational view of the nozzle in FIG. 2 looking in the direction of the arrows 5—5 in FIG. 2.

A conical tip 80 on a pintle 82 is held in place by a U-shaped bracket 84 bridging the outlet port 40 as best shown in FIG. 5. The conical tip 80 is located slightly downstream of the outlet port 40 and is positioned to direct the fluidized coal/air mixture from the outlet port 40 into a divergent spray cone pattern in the space 42 of the combustor 46 for burning within the combustion chamber 48. Additionally, the nozzle 38 includes an air manifold ring 86 including spaced walls 88, 90 and a threaded inlet 91 connected to a tube 92 from a pressurized air source 94 with a modulating valve 95 being included in tube 92 between source 94 and inlet 91. The inlet 91 communicates with an annular groove 94 in the manifold 86. Groove 94 overlies an annular channel 96 in the outer surface of the elongated housing 50. A plurality of inclined passages 98, 100 are formed through the wall of the housing 50 to intercommunicate the annular channel 96 with the bore 60 at diammetrically spaced segments 104, 106 of the helically formed coal/air passage 78 formed between the scroll generator 62 and the bore surfaces 74, 76.

The manifold ring 86 is held in place and sealed with respect to the housing 50 by a retainer nut 108 threaded on an externally threaded outer surface 110 of the housing adjacent the inlet port 36. An annular gasket 112 is held between the retainer nut 108 and the ring 86 to seal therebetween. The opposite end of the ring 86 is in engagement with an annular gasket 114 held in place by a flange 116 on a threaded collar 118 that is secured to the domed end 44 by a nozzle support tube 120 having an externally threaded surface 122 thereon threadably engaged by the collar 118. Tube 120 is thereby positioned to locate a seal gasket 124 between the outboard end 123 of the tube 120 and a locating shoulder 126 on the outer surface of the housing 50 intermediate the ends thereof. The domed end 44 is sealed with respect to the retainer tube 120 and an external retainer plate 128 by spaced gaskets 130, 132.

In the illustrated arrangement, the retainer tube 120 has an inboard flange 134 thereon that is formed with a conical relief surface 136 in surrounding relationship to the nozzle outlet port 40. Surface 136 has an included angle exceeding that of the maximum spray cone angle of fluidized coal and air mixture directed from the nozzle 38.

Figure 3:
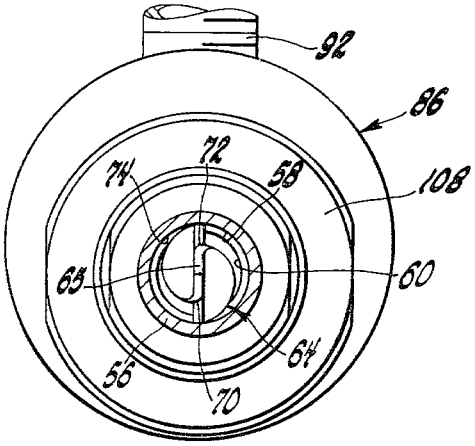
FIG. 3 is a cross-sectional view taken along the line 3—3 of FIG. 2 looking in the direction of the arrows.
Figure 4:
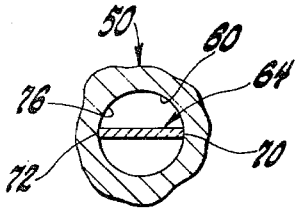
FIG. 4 is a cross-sectional view taken along the line 4—4 of FIG. 2 looking in the direction of the arrows.

In accordance with the principles of the present invention, and as best seen in FIGS. 2–4, the scroll generator 62 is formed by surfaces of the bores 58, 60 and the thin, flat metal element 64 because it is twisted along its length. In the embodiment illustrated in FIG. 2, the twist in element 64 is 450° between the tapered inlet end 65 and the outlet edge 68 of the element 64. The 450° twist increases the intensity of swirl imparted to the fluidized air/coal mixtures so that there is a strong rotary motion imparted in the fluidized air/coal mixture which is sustained in the mixture as it flows from the outlet port 40. At this point the rotary swirl motion is directed into a coal/air spray cone across the tip 80 of the pintle 82 to define a desired spray cone angle within the combustor. The degree of swirl is established in part by the additional air blast jets formed by the inclined passages 98, 100. The jets formed by passages 98, 100 are formed at an inclination with respect to the helical flow path 78 and are located tangentially with respect to the diameter of the bore 60 to enhance the degree of swirl. An axial component from the air jets assists and boosts the flow of the fluidized coal/air mixture through the nozzle housing 50. Moreover, by modulating the air pressure flow through the air jet passages 98, 100 the spray cone angle can be varied to produce variances in recirculation of flow within the combustor so as to establish a desired level of recirculation of combustion products through the space 42 for complete burning of the coal particles thereby to produce a resultant reduction of emissions from the combustor.

The illustrated length-to-diameter ratio of the scroll generator 62 shown in the embodiments of FIGS. 1 through 5 is greater than one so as to impart a continuous change in direction in the fluidized air/coal mixture as it passes through the helical passage 78 and a sustained swirl into the space 42.

The pintle 82 is spaced from the outlet edge 68 of the element 64 so that the swirl will be maintained as the fluidized air/coal mixture flows through a transition space 138 formed at the end of the nozzle assembly upstream at pintle 82.

Figure 6:
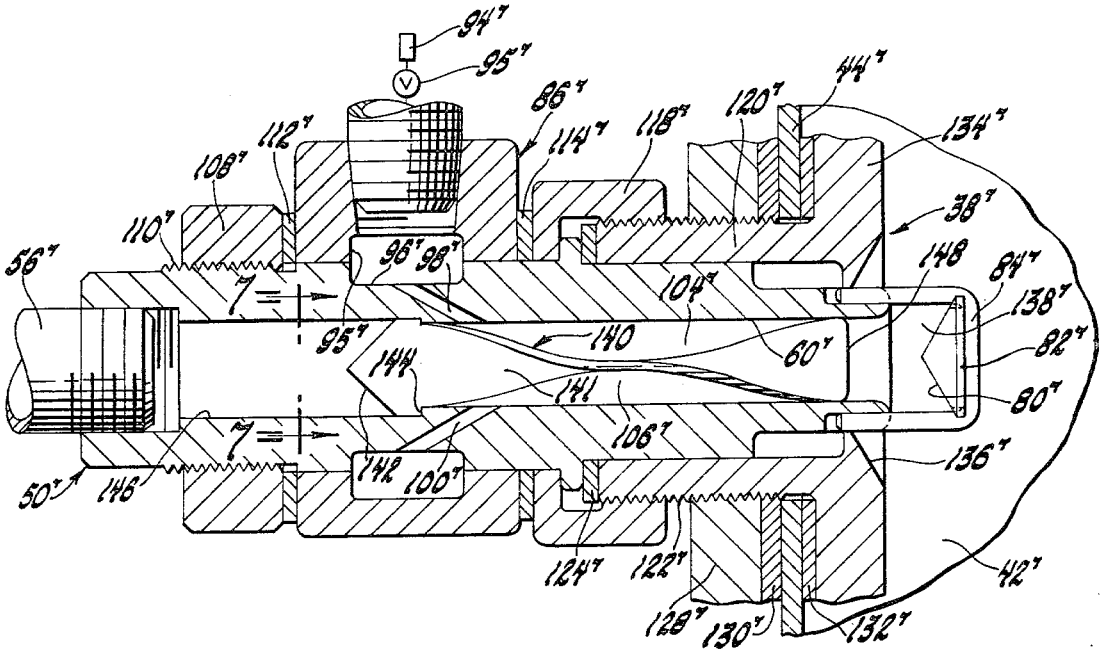
FIG. 6 is a longitudinal sectional view of a second embodiment of the present invention with a swirl generator shown in elevation.
Figure 7:
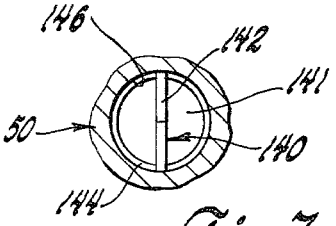
FIG. 7 is a cross-sectional view taken along the line 7—7 of FIG. 6.

The embodiment of the invention shown in FIGS. 6 and 7 includes a modified scroll generator 140 formed by a thin flat metal insert element 141 with a tapered inlet end 142 thereon seated against a stepped shoulder 144 of an inlet bore 146. The scroll element 141 is twisted 180° between the inclined tip 142 and straight outlet edge 148. Otherwise, the nozzle assembly corresponds to the arrangement shown in FIG. 2 and for economy of description, the elements in FIGS. 6–7 corresponding to like elements in the embodiment of FIGS. 1–5 are designated with like reference numerals which are primed.

The term fluidized as used above encompasses, without limitation, coal dust entrained in a stream of air and includes, for example, two-phase flow of coal dust in an air stream, pneumatic transport of coal dust in an air stream as well as the classical case of a fluidized bed of particles moving in a pipe. Further, the term coal as used above encompasses, without limitation, other fuel particles with a high energy content, for example, coal derived particles with most of the ash removed or coal with most volatiles removed, leaving a larger amount of fixed carbon.

While the embodiments of the present invention, as herein disclosed, constitute a preferred form, it is to be understood that other forms might be adopted.

The embodiments of the invention in which an exclusive property or privilege is claimed are defined as follows:

1. A powdered coal/air dispersion nozzle for introducing a fluidized coal/air fuel mixture as a finely atomized dispersed spray for uniform combustion in a gas turbine engine combustor apparatus comprising: an elongated nozzle tube having an inlet for connection to a fluidized coal/air source with a coal particle size in the range of one to three hundred microns, said elongated nozzle tube having an outlet therefrom, scroll means including a sheet element located within said nozzle tube having spaced longitudinal edges thereon in engagement with said tube, said sheet element having a thin cross-section at all points throughout the twisted length thereof to prevent build-up of coal particles through the length of said scroll means, said sheet element being twisted along its length to impart a continuous swirl to the fluidized coal/air fuel mixture supplied to the inlet and said sheet element having a length-to-width ratio greater than one to impart a swirl in the fluidized coal/air mixture which is sustained as the fluidized coal/air fuel mixture is directed from said outlet, and pintle means overlying said outlet and operative to direct said sustained swirl of the fluidized coal/air mixture as a spray cone for combustion within the combustor.

2. A powdered coal/air dispersion nozzle for introducing a fluidized coal/air fuel mixture as a finely atomized dispersed spray for uniform combustion in a gas turbine engine combustor apparatus comprising: an elongated nozzle tube having an inlet for connection to a fluidized coal/air source with a coal particle size in the range of one to three hundred microns, said elongated nozzle tube having an inlet therefrom, scroll means including a sheet element located within said nozzle tube having spaced longitudinal edges thereon in engagement with said tube, said sheet element having a thin cross-section at all points throughout the twisted length thereof to prevent build-up of coal particles through the length of said scroll means, said scroll element further including a tapered inlet nose thereon to prevent coal build-up immediately downstream of the inlet of said nozzle tube, said sheet element being twisted along its length to impart a continuous swirl to the fluidized coal/air fuel mixture supplied to the inlet and said sheet element having a length-to-width ratio greater than one to impart a swirl in the fluidized coal/air mixture which is sustained as the fluidized coal/air fuel mixture is directed from said outlet, and pintle means overlying said outlet and operative to direct said sustained swirl of the fluidized coal/air mixture as a spray cone for combustion within the combustor.

3. A powdered coal/air dispersion nozzle for introducing a fluidized coal/air fuel mixture as a finely atomized dispersed spray for uniform combustion in a gas turbine engine combustor apparatus comprising: an elongated nozzle tube having an inlet for connection to a fluidized coal/air source with a coal particle size in the range of one to three hundred microns, said elongated nozzle tube having an outlet therefrom, scroll means including a sheet element located within said nozzle tube having spaced longitudinal edges thereon in engagement with said tube, said sheet element having a thin cross-section at all points throughout the twisted length thereof to prevent build-up of coal particles through said scroll means, said sheet element being twisted along its length to impart a continuous swirl to the fluidized coal/air fuel mixture supplied to the inlet and said sheet element having a length-to-width ratio greater than one to impart a swirl in the fluidized coal/air fuel mixture is directed from said outlet, pintle means overlying said outlet and operative to direct said sustained swirl of the fluidized coal/air mixture as a spray cone for combustion within the combustor, and means for injecting air jets into at least part of said scroll means, said jets being directed at an inclination with respect to the longitudinal axis of said nozzle tube thereby to impart an axial thrust component on the fluidized coal/air swirl pattern within the nozzle tube to further assist in the transfer of coal particles from said inlet to said outlet and so as to further enhance swirl generation from said outlet.

4. A powdered coal/air dispersion nozzle for introducing a fluidized coal/air fuel mixture as a finely atomized dispersed spray for uniform combustion in a gas turbine engine combustor apparatus comprising: an elongated nozzle tube having an inlet for connection to a fluidized coal/air source with a coal particle size in the range of one to three hundred microns, said elongated nozzle tube having an outlet therefrom, scroll means including a sheet element located within said nozzle tube having spaced longitudinal edges thereon in engagement with said tube, said sheet element having a thin cross-section at all points throughout the twisted length thereof to prevent build-up of coal particles through the length of said scroll means and a tapered inlet nose thereon to prevent coal build-up immediately downstream of the inlet of said nozzle tube, said sheet element being twisted along its length to impart a continuous swirl to the fluidized coal/air fuel mixture supplied to the inlet and said sheet element having a length-to-width ratio greater than one to impart a swirl in the fluidized coal/air mixture which is sustained as the fluidized coal/air fuel mixture is directed from said outlet, pintle means overlying said outlet and operative to direct said sustained swirl of the fluidized coal/air mixture as a spray cone for combustion within the combustor, and means including a variable source of pressure for injecting air jets into at least part of said scroll means, said jets being directed at an inclination with respect to the longitudinal axis of said nozzle tube thereby to impart an axial thrust component on the fluidized coal/air swirl pattern within the nozzle tube to further assist in the transfer of coal particles from said inlet to said outlet and so as to further enhance swirl generation from said outlet, said variable source of pressure being variable to adjust the included angle of spray cone formed by said pintle means thereby to control the degree of recirculation of combustion products within the combustor.

* * * * *